US009079646B2

(12) United States Patent
Gould et al.

(10) Patent No.: US 9,079,646 B2
(45) Date of Patent: Jul. 14, 2015

(54) CHILD RESTRAINT SWIMMING DEVICE

(71) Applicant: AQUA-LEISURE INDUSTRIES, INC., Avon, MA (US)

(72) Inventors: Benjamin Gould, Norwood, MA (US); Caitlin Wotherspoon, Warwick, RI (US)

(73) Assignee: AQUA-LEISURE INDUSTRIES, INC., Avon, MA (US)

( * ) Notice: Subject to any disclaimer, the term of this patent is extended or adjusted under 35 U.S.C. 154(b) by 0 days.

(21) Appl. No.: 14/270,111

(22) Filed: May 5, 2014

(65) Prior Publication Data

US 2014/0325731 A1 Nov. 6, 2014

Related U.S. Application Data

(60) Provisional application No. 61/819,862, filed on May 6, 2013.

(51) Int. Cl.

| | |
|---|---|
| ***A41D 5/00*** | (2006.01) |
| ***B63C 9/11*** | (2006.01) |
| ***A41D 7/00*** | (2006.01) |
| ***A63B 31/00*** | (2006.01) |

(52) U.S. Cl.
CPC ... *B63C 9/11* (2013.01); *A41D 7/00* (2013.01); *A63B 31/00* (2013.01)

(58) Field of Classification Search
CPC ... A41D 7/00; A41D 14/0015; A41D 13/012; A41D 1/04; A41F 11/16; A41F 9/002; A62B 35/04; A62B 1/14; A62B 35/0025; A64D 17/30; A47D 13/086; A47D 15/006; A63B 69/12; A63C 9/155; A63C 9/1255; A63C 9/115
USPC ..... 2/67, 69, 82, 102, 94, 311, 312, 456; 182/3–6; 244/151 R; 119/770, 857, 119/907; 482/55; 441/108, 111, 112, 114, 441/115, 116, 119, 123
See application file for complete search history.

(56) References Cited

U.S. PATENT DOCUMENTS

| | | | | |
|---|---|---|---|---|
| 4,276,670 | A | 7/1981 | Marchello et al. | |
| 5,435,272 | A * | 7/1995 | Epstein | 119/770 |
| 5,588,891 | A | 12/1996 | Bardot | |
| 6,125,792 | A * | 10/2000 | Gee | 119/770 |
| 8,333,682 | B2 * | 12/2012 | Sporn | 482/55 |
| 8,336,503 | B2 * | 12/2012 | Spinelli | 119/770 |
| 2005/0239027 | A1 | 10/2005 | Streeter et al. | |
| 2012/0208158 | A1 | 8/2012 | Coulombe | |
| 2012/0208159 | A1 | 8/2012 | Coulombe | |

* cited by examiner

*Primary Examiner* — Tejash Patel
(74) *Attorney, Agent, or Firm* — Lando & Anastasi LLP

(57) ABSTRACT

A safety device comprising a body portion secured to the torso of a swimmer and having support straps and a handle to permit an instructor to provide support for the swimmer is disclosed. The safety device may be used for a variety of purposes, such as teaching individuals how to swim. During use, an instructor or other individual may provide support and/or guidance for the swimmer by lifting or pulling on the handle. The device may be constructed to provide both freedom of movement for the swimmer and direct contact with the instructor, thereby allowing for a safe, yet challenging, learning experience.

22 Claims, 5 Drawing Sheets

CHILD RESTRAINT SWIMMING DEVICE

RELATED APPLICATION

This application claims priority under 35 U.S.C. 119(e) to U.S. Provisional Application No. 61/819,862, titled "SAFETY DEVICE FOR SWIMMING," filed May 6, 2013, which is hereby incorporated by reference in its entirety for all purposes.

BACKGROUND OF THE DISCLOSURE

1. Field of the Invention

This invention relates to a safety device, and particularly to a safety device for young would-be swimmers. The safety device may be configured to fit around the torso of a swimmer and may include a handle. The handle may be attached to the device so that an instructor or other person may provide support for the swimmer while allowing for full freedom of movement. The safety device may further include one or more panels, straps, and/or fasteners so as to provide a customized fit for any sized swimmer.

2. Discussion of Related Art

A novice swimmer may not have developed a sense of his or her own buoyancy or control of his or her body when attempting to swim. In an effort to teach individuals these skills, swim instructors may use one or more safety devices to help support the student. One common problem with many of these devices is that they may be constructed from one or more parts that float in water. This may impede the student's ability to learn to remain buoyant under his or her own direction. Other devices currently available on the market may be bulky or may fail to remain secured to the student's body. These devices may interfere with the student's ability to move freely and safely in the water while under the guidance of the instructor. The instant invention is directed to a safety device that remains secured to a swimmer's body and allows a novice swimmer to develop and appreciate his or her own sense of buoyancy while still allowing freedom of movement.

SUMMARY

In accordance with one or more embodiments, a child restraint swimming device is provided. The child restrain swimming device includes a front panel constructed of flexible material and comprising an upper edge, a lower edge, a first side edge, and a second side edge, the first side edge and the second side edge extending between the upper edge and the lower edge, at least one side panel constructed of flexible material and attached to at least one of the first side edge and the second side edge of the front panel, a neck band attached to an upper portion of the front center panel and configured to define an opening between the neck band and the upper portion to receive a head of the child, and a back strap having a first end attached to the neck band and a second end attached to a bottom edge of the front panel.

According to one embodiment, the back strap further includes a first segment configured as a handle positioned adjacent the first end of the back strap. According to another embodiment, the back strap further includes a second segment configured as a crotch strap positioned adjacent the second end of the back strap. In one embodiment, the back strap further includes an adjustable fastener configured to join the first segment and the second segment. In certain embodiments, the handle is constructed from a length of flexible material configured to encircle a portion of the back strap.

According to some embodiments, a first side panel attaches to the first side edge to define a first opening to receive a first arm of the child, and a second side panel attaches to the second side edge to define a second opening to receive a second arm of the child. In another embodiment, the child restraint swimming device further includes an adjustable fastener configured to attach the first side panel and the second side panel to each other. According to some embodiments, the front panel, the first side panel, and the second side panel are constructed from one continuous piece of flexible material.

In accordance with at least one embodiment, the neck band includes a first end attached to the upper portion of the front panel at a first position, and a second end attached to the upper portion of the front panel at a second position, and the child restraint swimming device further includes a first support strap having a first end attached to the first end of the neck band at the first position and a second end attached to the lower edge of the front panel, and a second support strap having a first end attached to the second end of the neck band at the second position and a second end attached to the lower edge of the front panel. In some embodiments, the second end of the first support strap and the second end of the second support strap are attached at substantially the same position on the lower edge of the front panel.

According to one embodiment, the flexible material is selected from the group consisting of neoprene, polyester, spandex, and combinations thereof.

In accordance with one or more embodiments, a safety device for swimming is disclosed that includes a body portion constructed from flexible material and configured to encircle a wearer's torso, a neck band connected to the body portion and configured to create a neck hole, and a back strap connected to the neck band and the body portion and configured to extend between the legs and along the back of the wearer.

According to one embodiment, the back strap further includes a handle configured to be positioned at the upper back region of the wearer's torso. In some embodiments, the handle is further positioned at a top central portion of the neck band. In other embodiments, the back strap includes two separate segments and the safety device further includes an adjustable fastener configured to attach the two segments together.

According to at least one embodiment, the back strap is constructed from a nylon webbing material that is covered with tubular shaped flexible material.

According to another embodiment, the body portion further includes a first armhole and a second armhole configured to receive the wearer's arms. In some embodiments, the body portion further includes an adjustable fastener to secure the body portion around the wearer's torso. In certain embodiments, the body portion further includes two side panels configured to wrap around the wearer, and the adjustable fastener is configured to attach the two side panels to one another.

According to at least one embodiment, the body portion further includes a pair of support straps connected to the neck band and the back strap and configured to extend from an upper edge to a lower edge of the body portion.

In accordance with one or more embodiments, a child restraint swimming device is disclosed that includes a panel constructed of flexible material and including first and second opposing side edges, the panel having an opening to receive a head of the child, a first support strap having a first end attached to an upper portion of the panel at a first location and a second end attached to the upper portion of the panel at a second location, the first support strap extending around the back of the opening, and a back strap attached to a top central portion of the first support strap and attached to a lower portion of the panel.

According to one embodiment, the back strap further includes a handle located adjacent the first support strap.

According to another embodiment, the child restraint swimming device further includes a second support strap having a first end attached to the upper portion of the panel and a second end attached to the lower portion of the panel.

According to at least one embodiment, the lower portion of the panel further includes a first opening to receive a first leg of the child and a second opening to receive a second leg of the child.

BRIEF DESCRIPTION OF THE DRAWINGS

The accompanying drawings are not intended to be drawn to scale. The identical or nearly identical component or feature that is illustrated in various figures is represented by a like numeral. For purposes of clarity, not every component may be labeled in every drawing, nor is every component of each embodiment of the invention shown when illustration is not necessary to allow those of ordinary skill in the art to understand the invention. In the drawings.

DETAILED DESCRIPTION

The present invention is directed to a safety device for swimming that is constructed from flexible material and may be configured to fit securely around the torso of a swimmer. The safety device includes at least one handle and may be constructed from one or more panels, straps, and fasteners. In some embodiments, the handle may be positioned along the back of the swimmer. When an instructor pulls on the handle, the resulting force may be distributed in a substantially equal amount around the torso of the swimmer.

Figure 1:
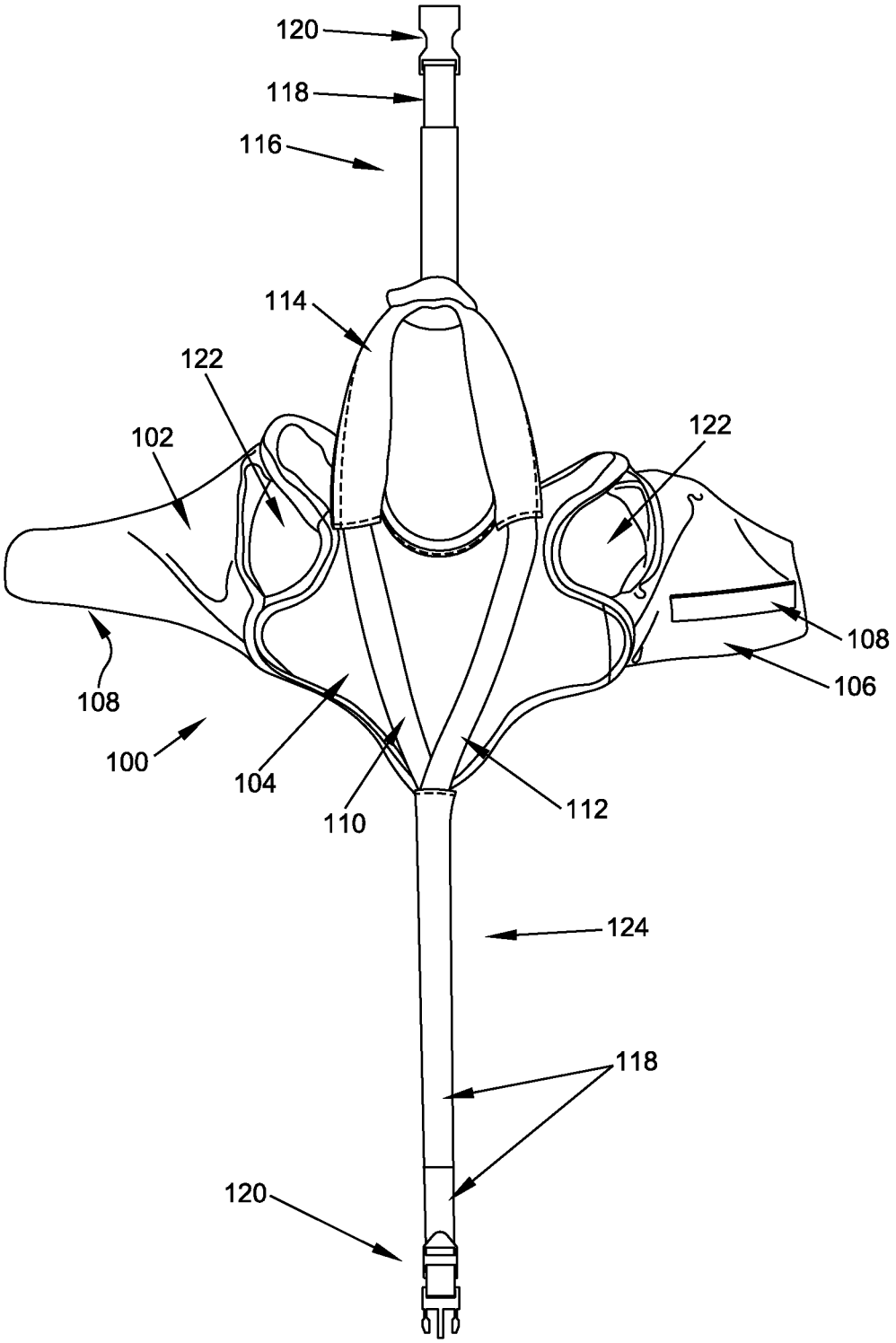
FIG. 1 is a plan view of the front of the safety device with a body portion in an open position, according to one embodiment of the invention.

Referring to FIG. 1, the safety device may include a body portion 100 that wraps or fits around the torso of a swimmer. Body portion 100 may be constructed from a center panel 104, also referred to as a "front panel," a first side panel 102, and a second side panel 106. Side panels 102 and 106 may include one or more fasteners 108 that, when affixed together, serve to hold body portion 100 in a closed position around the torso of the swimmer, with side panels 102 and 106 wrapped around and secured in place at the back of the swimmer. Non-limiting examples of suitable fasteners may include hook and loop fasteners, button and button holes, snap fittings, buckles, and the like. Fastener 108 (not shown) is affixed to the underside of side panel 102. When the device is in a closed position, side panel 102 is placed over side panel 106 so that fastener 108 positioned on side panel 102 attaches to fastener 108 positioned on side panel 106. Although FIG. 1 illustrates body portion 100 as being constructed from three panels, body portion 100 may also be constructed from one, two, or more panels. For example, the entire body portion of the safety device may be constructed from a single panel.

In accordance with one or more embodiments, body portion 100 may be constructed from any one of a number of flexible materials, such as, for example, neoprene, polyester, spandex, and any combination thereof. Accordingly, body portion 100 may be constructed from any one of a variety of woven or non-woven textiles, provided that such materials are capable of performing the various functions related to the safety device as disclosed herein. In certain embodiments, the material used to construct body portion 100 may further include sewn-in padding, which may provide further comfort to the swimmer. Side panels 102 and 106 may be attached at an upper section and a lower section of center panel 104 so as to create arm openings 122 for the swimmer. Support straps 110 and 112 may be attached to and extend from body portion 100. Support straps 110 and 112 may extend from the upper edge to the lower edge of body portion 100 in a slightly diagonal direction down center panel 104. Support straps 110 and 112 may be attached to center panel 104 at both their respective top and bottom, or may be attached to center panel 104 along their entire length.

As seen in FIG. 1, a neck band 114 may be attached to the upper edge of body portion 100. Neck band 114 may be constructed to extend in a semi-circle behind the swimmer's neck. The two ends of neck band 114 may be sewn or otherwise attached to center panel 104 in a region corresponding to the upper torso or shoulders of the swimmer. In various embodiments, the combination of neck band 114 and center panel 104 may form an opening through which the head of the swimmer may be received. Neck band 114 may further be secured to support straps 110 and 112. In some embodiments, neck band 114 may be constructed from the same material as body portion 100. In other embodiments, neck band 114 may be constructed from nylon webbing that is at least partially covered with tubular shaped flexible material, such as neoprene. In certain embodiments that are not shown, support straps 110 and 112 may be constructed from nylon webbing and expand beyond the center panel 104 to form neck band 114. In at least one embodiment, a tubular shaped flexible material, such as neoprene, may be sewn around at least a portion of the nylon webbing to provide additional strength to the safety device and additional comfort for the swimmer.

In other embodiments that are not shown, the body portion may comprise a single panel of flexible material having an opening to receive the head of the swimmer and a pair of openings to receive the legs of the swimmer. A first support strap is affixed to each side of the upper torso of the body portion and extends behind the head opening, where it may be attached to a back strap that extends from the lower portion of the panel and along the back of the swimmer. An adjustable fastener may also be included that is configured to separably connect the first support strap to the back strap. The back strap may further include a handle that may be located adjacent the first support strap. A second support strap, otherwise referred to as a back support strap, may extend from the lower portion of the panel adjacent the lower torso of the swimmer along the back of the swimmer and attach to an upper portion of the panel.

Attached to the lower edge of body portion 100 and a top central portion of neck band 114 may be a back strap 118. One end of back strap 118 may be sewn or otherwise secured to center panel 104 in a region corresponding to the lower torso of the swimmer and may further be configured to extend between the legs of the swimmer. Back strap 118 may also be secured to support straps 110 and 112. The other end of back strap 118 may be attached to a top central portion of neck band 114. As illustrated in FIG. 1, back strap 118 may further include an adjustable fastener 120 that serves to divide back strap 118 into two separable and attachable segments. With the two segments unattached, the device may be placed around the swimmer's body, the arm being slipped through the armholes, and the neck band being slipped over the swimmer's head. The device is then secured in place by connecting the segments using fastener 120. When the device is fully secured around the swimmer, fastener 120 will preferably be positioned above his or her back.

In various embodiments, back strap 118 may be constructed from nylon webbing. In at least one embodiment, neoprene tubular material may be sewn over one or more regions of back strap 118. For example, a crotch band 124 may be included along a portion of back strap 118. In certain instances, the neoprene tubular material may be sewn around the nylon webbing to form a seam along a center region of the webbing. Depending on the desired construction, the tubular material may be sewn around the nylon webbing, or in the alternative, may be sewn directly to the webbing material. When the safety device is fully secured around the swimmer, crotch band portion 124 may extend downward from center panel 104, between the legs of the swimmer, and then upward to a region above the back of the swimmer.

Back strap 118 may further include a handle 116. In certain embodiments, handle 116 may be constructed from flexible material, such as neoprene tubular material, sewn around back strap 118, as previously described. Handle 116 may be positioned anywhere along back strap 118, and according to some embodiments, the flexible material may be configured to encircle a portion of the back strap. According to some embodiments, handle 116 may be slid into the desired position anywhere along back strap 118. As illustrated in FIG. 1, handle 116 may be positioned near or attached to neck band 114. In this embodiment, handle 116 may be attached to a top central portion of neck band 114. When the safety device is fully secured around the swimmer, handle 116 may be positioned at the upper back region of the swimmer's torso. In certain embodiments, fastener 120 is positioned along back strap 118 below handle 116 and above crotch band 124. Fastener 120 may be adjusted to lengthen or shorten back strap 118 to ensure a secure fit of the device to the swimmer.

Figure 2C:
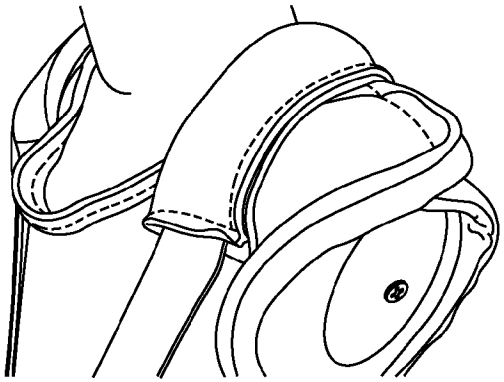
FIG. 2C is a close-up of the shoulder area of the safety device shown in FIG. 2B.
Figure 2B:
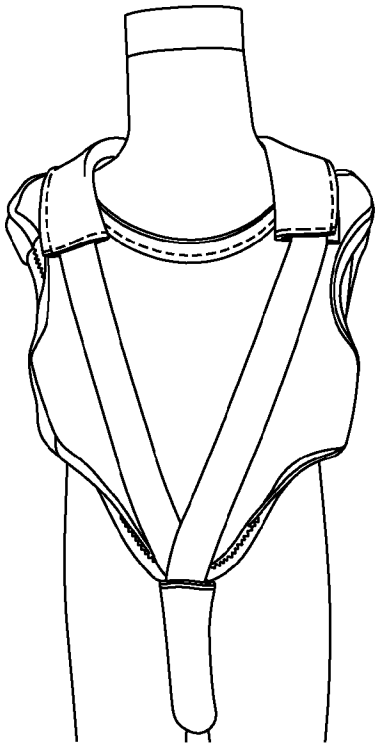
FIG. 2B is a front view of the safety device as shown on a fitting form.
Figure 2A:
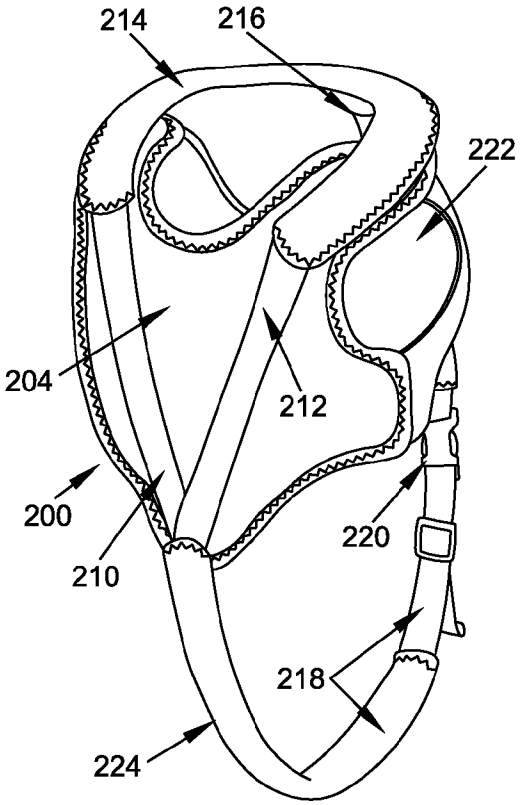
FIG. 2A is a front perspective view of a safety device with a body portion in a closed position, according to at least one embodiment of the invention.
Figure 3C:
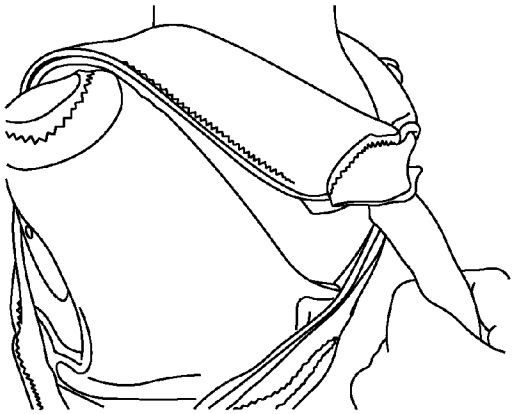
FIG. 3C is a close-up of the neck area of the safety device shown in FIG. 3B.
Figure 3D:
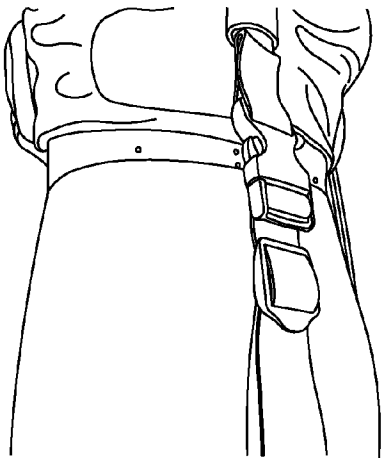
FIG. 3D is a close-up of a two-part closure mechanism located on the back of the safety device shown in FIG. 3B.
Figure 3B:
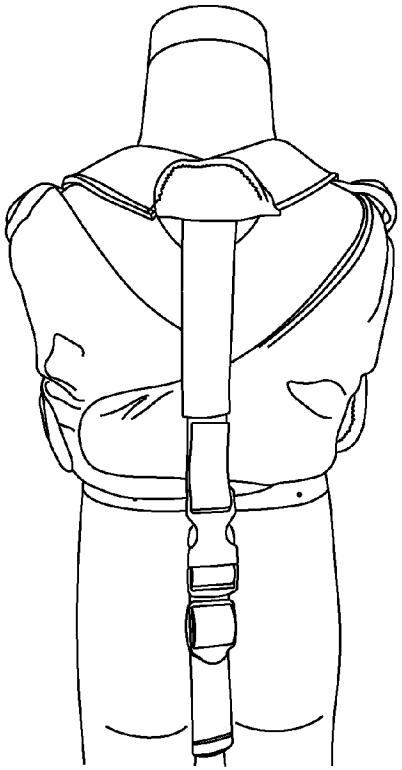
FIG. 3B is a rear view of the safety device as shown on a fitting form.
Figure 3A:
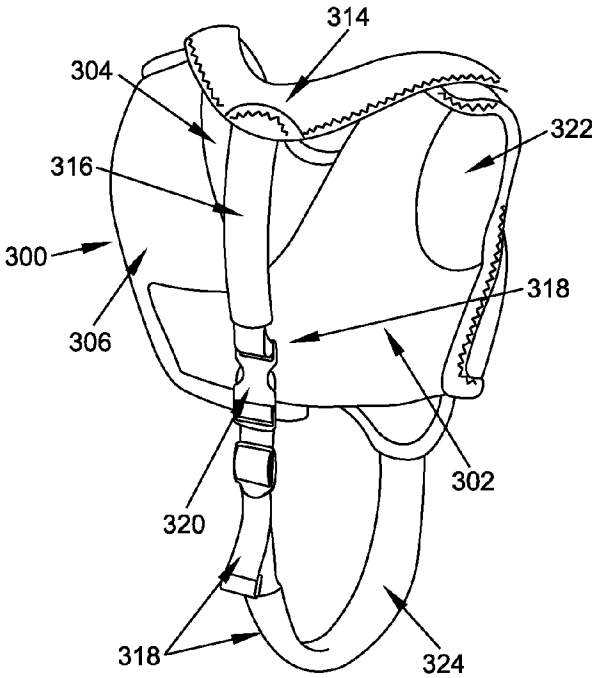
FIG. 3A is a rear perspective view of the safety device shown in FIG. 2A.

In FIGS. 2A-2C, a front view of the same safety device depicted in FIG. 1 is shown in a closed configuration that coincides with the manner in which the device may be secured to a swimmer. As illustrated, body portion 200 wraps around the torso, with center panel 204 positioned against the front chest of the swimmer. Neck band 214, support straps 210 and 212, back strap 218, fastener 220, and handle 216 (only partially visible in this view) may be constructed so that when an instructor or other individual pulls on handle 216, the resulting force is distributed in a substantially equal amount throughout the safety device. Constructing the safety device in this way may allow for not only better control over the swimmer by the instructor, but may also diminish or eliminate uncomfortable or dangerous pressure points (i.e., choking hazards) on the swimmer when the safety device is in use.

Referring to FIGS. 3A-3D, a rear view of the same safety device depicted in FIG. 1 is shown in a closed configuration. The body portion 300 includes side panels 302 and 306 may wrap or otherwise attach around the backside of the swimmer, and may further secure to each other using adjustable fastener 308. When the device is positioned onto the swimmer, the head may first be placed through the opening created by neck band 314 and center panel 304 (only partially visible in this view). Next, the arms of the swimmer may be placed through openings 322 created by center panel 304 and side panels 302 and 306. Side panels 302 and 306 may then be wrapped or positioned around the torso of the swimmer and secured to each other using fastener 308. Lastly, back strap 318 may be secured against the backside region of the swimmer by placing and pulling back strap 318 up between his or her legs and adjusting the length of back strap 318 via adjustable fastener 320. In this closed configuration, back strap 318, fastener 320, and handle 316 may be positioned on the exterior of panels 302 and 306. Removal of the device from the swimmer simply requires release of fastener 320 and reversal of the remaining steps.

Figure 4:
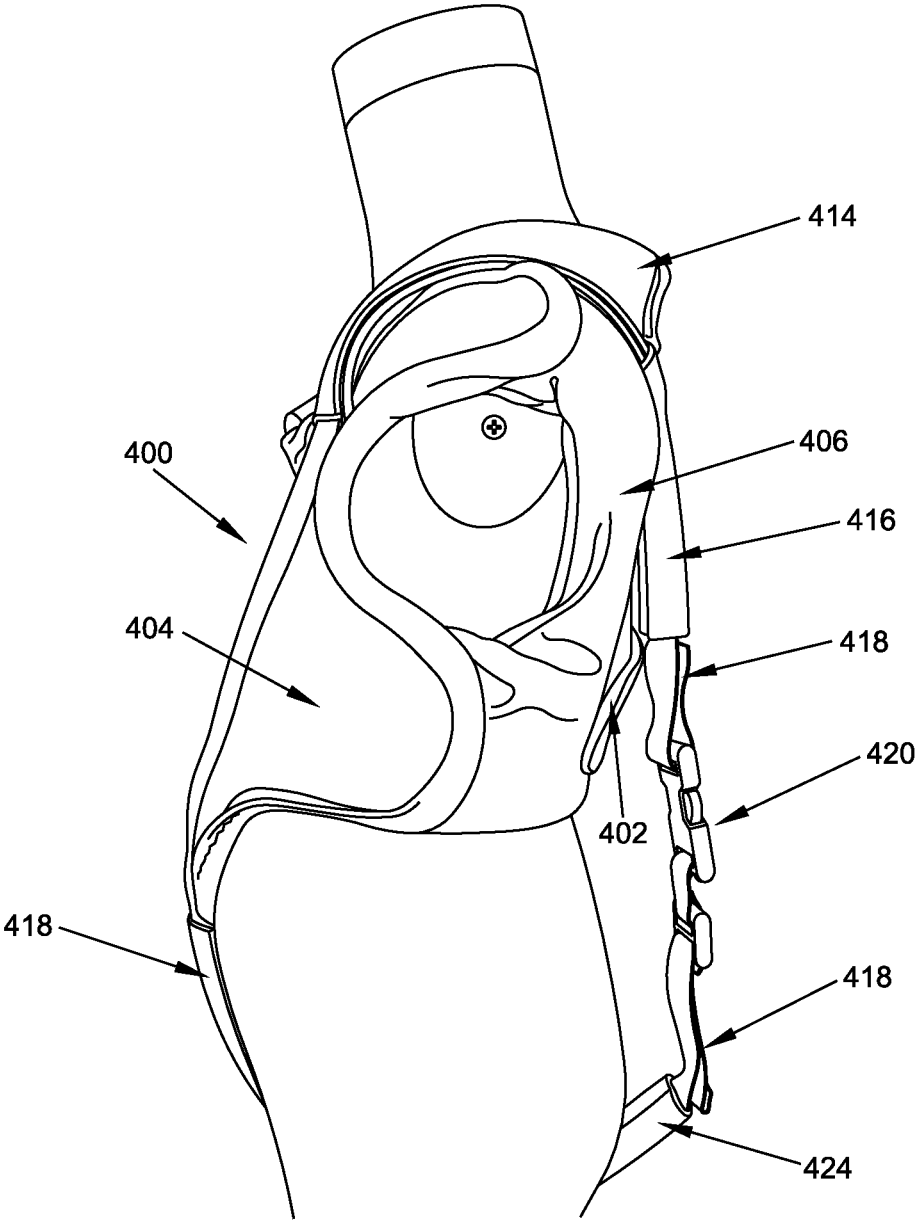
FIG. 4 is a side view of the safety device as shown on a fitting form.

A side view of the same safety device depicted in FIG. 1 in a closed configuration is illustrated in FIG. 4. The body portion 400 includes the features discussed above, including center panel 404 and side panels 402 and 406. Also shown are back strap 418, including handle 416 and crotch strap 424, neck band 414, and fastener 420, as discussed previously. As shown, handle 416 may be positioned near or at the upper backside region of the swimmer by adjusting fastener 420. When the instructor pulls handle 416, his or her hand may be positioned directly behind the neck of the swimmer. This position may not only allow the instructor to safely assist in keeping the head of the swimmer above water, but may also allow for minimal interference with the swimmer's ability to breathe properly. Further, when the safety device is in a closed configuration, it remains secured to the swimmer's body. This arrangement means that the device won't be accidentally removed from the swimmer, even when the instructor is pulling on the handle or the swimmer is moving aggressively.

Figure 5:
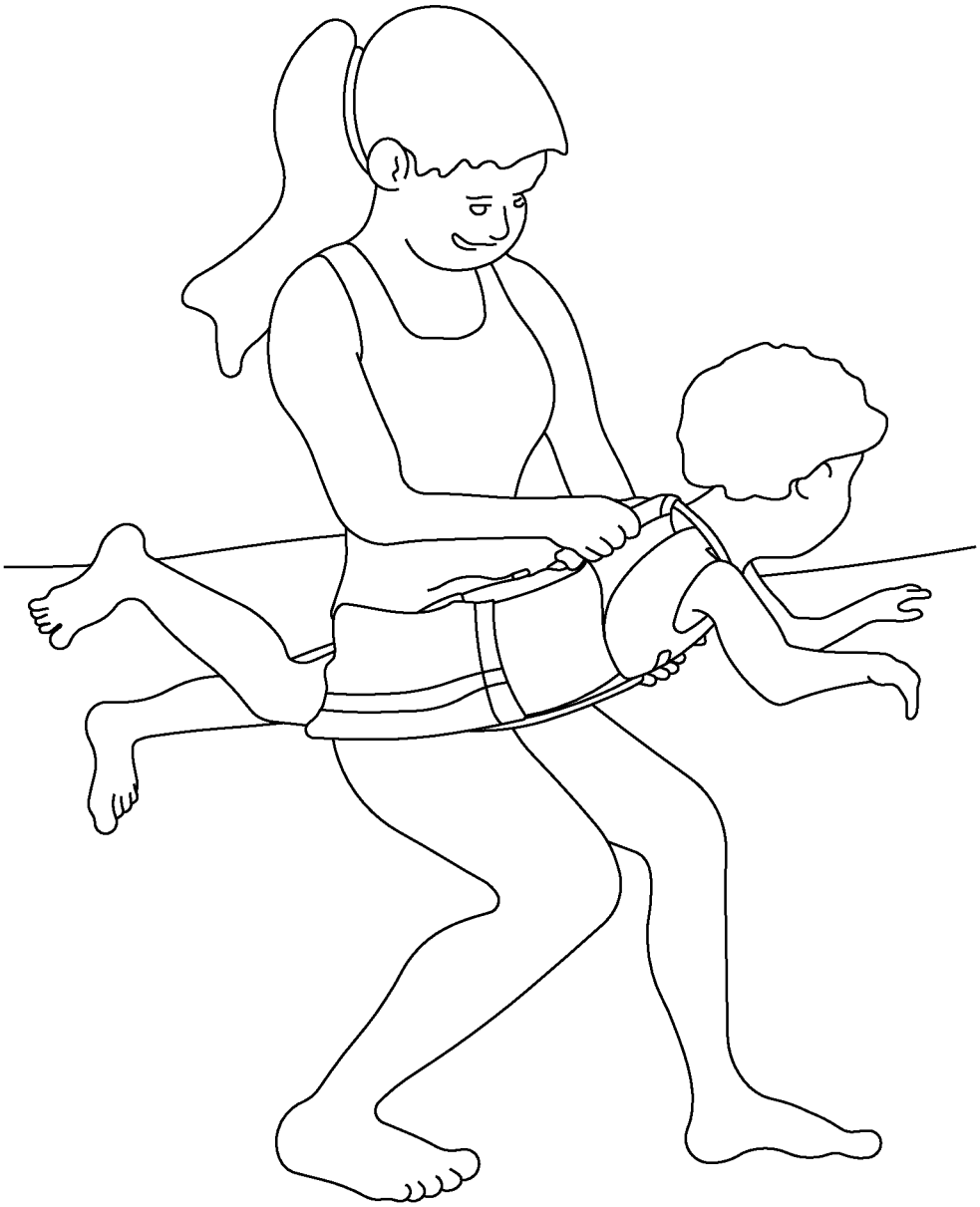
FIG. 5 is an illustration of the safety device in use.

Referring to FIG. 5, the safety device is shown in use. As illustrated, the device is secured around the torso of the swimmer and the instructor is able to engage with the device by pulling, as necessary, on the handle located on the upper back of the swimmer. In this arrangement, the swimmer is able to remain prone in the water with the ability to move freely and safely. Further, the swimmer is able to learn to remain buoyant with minimal interference from an instructor or other individual holding onto the safety device. However, the ability for the instructor or other individual to support and control the swimmer still remains intact.

Although particular embodiments of the invention have been described in detail for purposes of illustration, various modifications may be made without departing from the spirit and scope of the disclosure and its equivalents. For example, the safety device may be dimensioned for any sized individual, including children, infants, and adults. In addition, more than one handle may be positioned on the safety device, depending on the desired use. Further, the safety device is not limited to activities that involve swimming, and may be used in a variety of situations where some or total control of the wearer's movement is desired.

What is claimed is:

1. A child restraint swimming device, comprising:

a front panel constructed of flexible material and comprising an upper edge, a lower edge, a first side edge, and a second side edge, the first side edge and the second side edge extending between the upper edge and the lower edge;

a first side panel constructed of flexible material and attached to the first side edge to define a first opening to receive a first arm of the child;

a second side panel constructed of the flexible material and attached to the second side edge to define a second opening to receive a second arm of the child;

a neck band attached to an upper portion of the front panel and configured to define an opening between the neck band and the upper edge to receive a head of the child; and a back strap having a first end attached to the neck band and a second end attached to a bottom edge of the front panel.

2. The child restraint swimming device of claim 1, wherein the back strap further includes a first segment configured as a handle positioned adjacent the first end of the back strap.

3. The child restraint swimming device of claim 2, wherein the back strap further includes a second segment configured as a crotch strap positioned adjacent the second end of the back strap.

4. The child restraint swimming device of claim 3, wherein the back strap further comprises an adjustable fastener configured to join the first segment and the second segment.

5. The child restraint swimming device of claim 2, wherein the handle is constructed from a length of flexible material configured to encircle a portion of the back strap.

6. The child restraint swimming device of claim 1, further comprising an adjustable fastener configured to attach the first side panel and the second side panel to each other.

7. The child restraint swimming device of claim 1, wherein the front panel, the first side panel, and the second side panel are constructed from one continuous piece of flexible material.

8. The child restraint swimming device of claim 1, wherein the neck band includes a first end attached to the upper portion of the front panel at a first position, and a second end attached to the upper portion of the front panel at a second position, the child restraint swimming device further comprising:

a first support strap having a first end attached to the first end of the neck band at the first position and a second end attached to the lower edge of the front panel; and a second support strap having a first end attached to the second end of the neck band at the second position and a second end attached to the lower edge of the front panel.

9. The child restraint swimming device of claim 8, wherein the second end of the first support strap and the second end of the second support strap are attached at substantially the same position on the lower edge of the front panel.

10. The child restraint swimming device of claim 1, wherein the flexible material is selected from the group consisting of neoprene, polyester, spandex, and combinations thereof.

11. A safety device for swimming, comprising:

a body portion constructed from flexible material and configured to encircle a wearer's torso;

a neck band connected to the body portion and configured to create a neck hole; and a back strap connected to the neck band and the body portion and configured to extend between the legs and along the back of the wearer, and including a handle configured to be positioned at the upper back region of the wearer's torso.

12. The safety device for swimming of claim 11, wherein the handle is further positioned at a top central portion of the neck band.

13. The safety device for swimming of claim 11, wherein the back strap comprises two separate segments and the safety device further comprises an adjustable fastener configured to attach the two segments together.

14. The safety device for swimming of claim 11, wherein the back strap is constructed from a nylon webbing material that is covered with tubular shaped flexible material.

15. The safety device for swimming of claim 11, wherein the body portion further includes a first armhole and a second armhole configured to receive the wearer's arms.

16. The safety device for swimming of claim 15, wherein the body portion further includes an adjustable fastener to secure the body portion around the wearer's torso.

17. The safety device for swimming of claim 16, wherein the body portion further includes two side panels configured to wrap around the wearer, and the adjustable fastener is configured to attach the two side panels to one another.

18. The safety device for swimming of claim 11, wherein the body portion further includes a pair of support straps connected to the neck band and the back strap and configured to extend from an upper edge to a lower edge of the body portion.

19. A child restraint swimming device, comprising:

a panel constructed of flexible material and comprising first and second opposing side edges, the panel having an opening to receive a head of the child, a first armhole, and a second armhole configured to receive the child's arms;

a first support strap having a first end attached to an upper portion of the panel at a first location and a second end attached to the upper portion of the panel at a second location, the first support strap extending around the back of the opening; and a back strap attached to a top central portion of the first support strap and attached to a lower portion of the panel.

20. The child restraint swimming device of claim 19, wherein the back strap further includes a handle located adjacent the first support strap.

21. The child restraint swimming device of claim 19, further comprising a second support strap having a first end attached to the upper portion of the panel and a second end attached to the lower portion of the panel.

22. The child restraint swimming device of claim 19, wherein the lower portion of the panel further includes a first opening to receive a first leg of the child and a second opening to receive a second leg of the child.

* * * * *